US005267354A

United States Patent [19]

Grilliot et al.

[11] Patent Number: 5,267,354

[45] Date of Patent: Dec. 7, 1993

[54] MATERIAL CONSTRUCTION FOR IMPROVED PROTECTIVE GARMENT AND PROTECTIVE GARMENT CONTAINING SAME

[76] Inventors: William L. Grilliot; Mary I. Grilliot, both of P.O. Box 557, Dayton, Ohio 45417

[21] Appl. No.: 911,436

[22] Filed: Jul. 10, 1992

[51] Int. Cl.[5] ..... A41D 13/00

[52] U.S. Cl. ..... 2/23; 2/81; 2/227

[58] Field of Search ..... 2/23, 62, 79, 81, 125, 2/227, 59, 215; 450/31, 32, 54

[56] References Cited

U.S. PATENT DOCUMENTS

| | | | |
|---|---|---|---|
| 338,024 | 3/1886 | Bilbrough | 2/113 |
| 1,350,169 | 8/1920 | Mullane | 2/115 |
| 1,654,452 | 12/1927 | Bradley | 2/227 |
| 1,714,491 | 5/1929 | Burr | 2/115 |
| 1,842,472 | 1/1932 | Firsching, Jr. | 2/227 |
| 1,861,383 | 5/1932 | Ficcio | 2/227 |
| 2,371,584 | 3/1945 | Marrow et al. | 2/227 |
| 2,716,754 | 9/1955 | Hirsch | 2/227 |
| 4,831,666 | 5/1989 | Denman | 2/23 |
| 4,918,760 | 4/1990 | Grilliot et al. | 2/227 |
| 4,922,552 | 5/1990 | Grilliot et al. | 2/81 |
| 5,031,242 | 7/1991 | Aldridge et al. . | |
| 5,038,408 | 8/1991 | DeBaene | 2/227 |
| 5,072,454 | 12/1991 | Trahan . | |

FOREIGN PATENT DOCUMENTS 69325 11/1914 Switzerland ..... 2/130

*Primary Examiner*—Clifford D. Crowder
*Assistant Examiner*—Amy B. Vanatta
*Attorney, Agent, or Firm*—Roger A. Gilcrest

[57] ABSTRACT

The present invention includes a material member adapted for use in the extremity portion of a protective garment, a flexible extremity portion of a protective garment, a flexible extremity portion of a protective garment containing such a material member, and a protective garment containing such a flexible extremity portion.

In broadest terms, the material member of the present invention is one adapted for use in the extremity portion of a protective garment. The material member, considered as having a vertical axis, a horizontal axis and a flex point at the intersection of said axes comprises at least one layer of material, at least one of those layers containing an aperture defining an aperture area. The aperture encompasses the flex point and extends in both directions along the vertical axis; its width above the horizontal axis being less than its width below the horizontal axis. The aperture is covered by at least one cover piece each having a covering portion thereof covering the aperture. The covering portion(s) is/are of sufficient area whereby the surface area of each of the covering portions(s) is/are greater than the respective aperture area.

20 Claims, 2 Drawing Sheets

Fig. 1
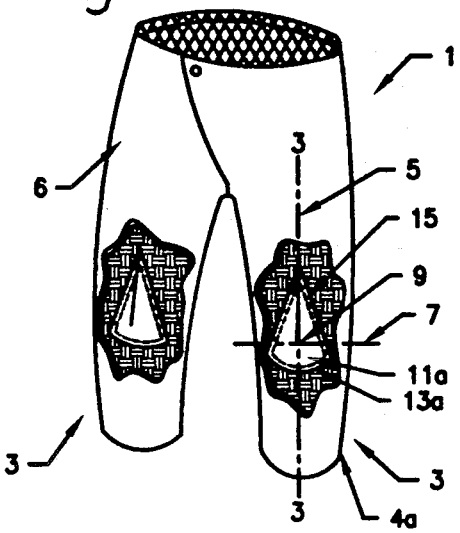
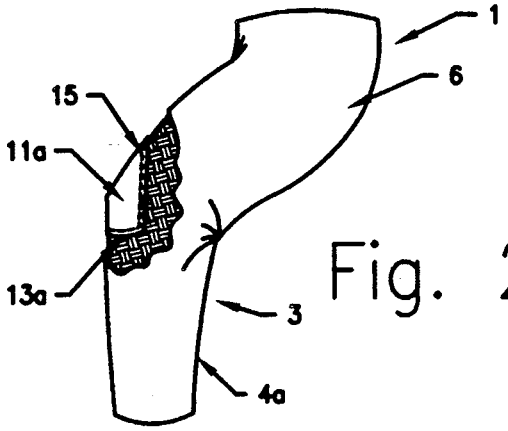
Fig. 2
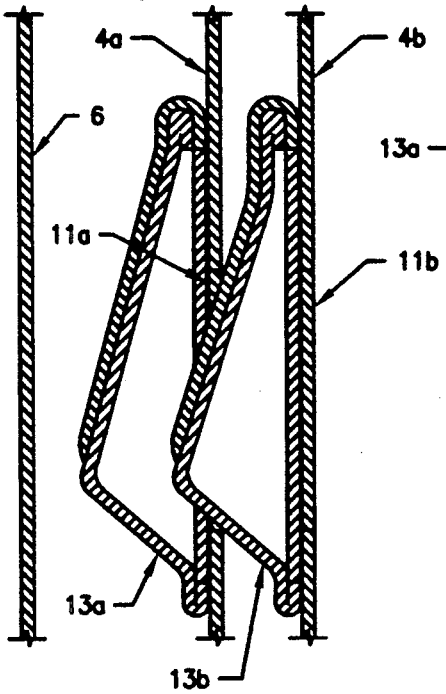
Fig. 3
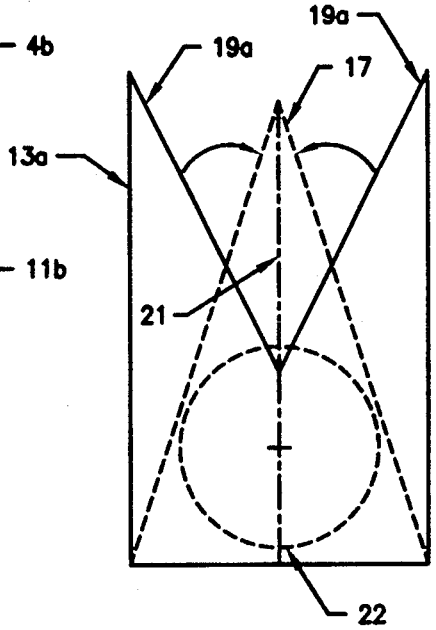
Fig. 4
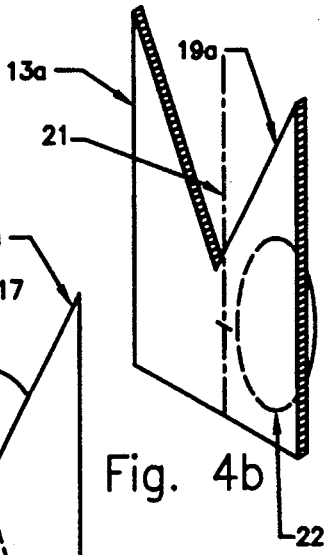
Fig. 4b
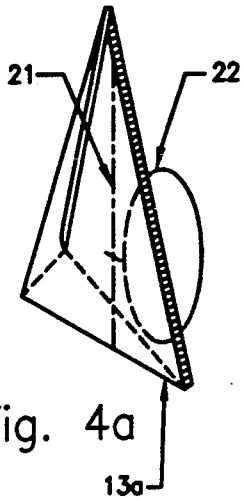
Fig. 4a

MATERIAL CONSTRUCTION FOR IMPROVED PROTECTIVE GARMENT AND PROTECTIVE GARMENT CONTAINING SAME

TECHNICAL FIELD

The present invention relates to an improved construction for the extremity portion of a multi-layered garment, such as multi-layered protective garments used by firefigthers, and the like. The garment features improved material constructions for the joint areas to allow for ease of movement while providing insulation from the environment.

BACKGROUND

In firefigther's garments and the like the use of multiple material layers can restrict movement causing difficulty for the wearer and increasing stress.

The human body redistributes itself during motion, such as during the flexing of extremity joints. During this movement, there is normally tension over one area of the material for every distension at another area of the material, in an extremity portion of the garment. For instance, the front of the unflexed human leg or the back of the unflexed human arm (particularly in the joint area) is significantly less tensed than the same body portion measured at full flex. This means unless clothing has sufficient excess in it to allow this "growth" during motion; it binds and restricts in fully flexed body portion. This is especially troubling in firefighting, since when the clothing is brought in tight contact to the body, insulation is reduced (as insulating air is forced out of the system). A garment pressed tightly against the firefigther's body presents a much more efficient pathway for burning injury to approach his body.

It would not be a solution simply to make the extremity portions of the garment oversized throughout so as to maintain an accommodating fit even when the wearers extremities are in a nonflexed positions. This would result in the firefigther being unable to work comfortably and efficiently due to the additional bulk and loose fit. Also, the cost of additional material would substantially increase the cost of the garment.

Various approaches have been made to resolve this problem. Examples of such approaches are described in U.S. Pat. No. 5,031,242 to Aldridge et al. and U.S. Pat. No. 5,072,454 to Trahan, both of which are hereby incorporated herein by reference. These patents teach providing the extremity portion of the garment with an aperture at the joint position, and covering this aperture with a cover piece of material adapted to provide additional space within the extremity portion at the joint position. The apertures and corresponding covering pieces used in the prior art can generally be described as rectangular or truncated elliptical in shape and generally symmetrical about the lateral axis passing through the "flex point" of the extremity, used herein to mean the point at which the elbow or knee bends. These constructions have the disadvantage of providing a geometry which is not precisely suited to the movement of a jointed body part; particularly about the flex point making such a construction unnecessarily expensive to produce. Also, although some of the cover pieces may be constructed of multiple pieces to make their final shape, these cover pieces generally collapse from their extended position (i.e. when the joint is flexed) once the extremity is straightened, leaving less space between the outer layer of the garment and the inner layer(s), space which can add desirable insulative value to these portions of the garment. Expansion areas which collapse upon straightening of the extremity must of course be re-extended upon each flex of the extremity joint, increasing the work load on the extremity.

In view of some of the shortcomings of the prior art, it is an object of the present invention to provide an extremity portion of a multi-layered protective garment, such as that used by a firefigther, which allows comfortable and unencumbered movement of the extremities while minimizing the cost of materials and manufacturing as compared to some other prior art constructions.

It is also an object of one embodiment to provide such an extremity portion of a multi-layered protective garment which allows for additional insulative space at the joint areas throughout the movement range of the extremity, and which aids in maintaining such space once extended, making subsequent joint flexion less stressful.

It is also an object of one embodiment of the present invention to produce a firefigther's garment which will comply with governing NFPA standards.

It should be understood that while some of the advantages of the protective garment of the present invention are described in terms of a firefigther's garment, the protective garment of the present invention is not limited to use in firefighting. Rather, it may be used for protection against similarly hostile environments.

The present invention represents an improvement over constructions of the prior art by achieving such objects and providing advantages flowing therefrom. Additional advantages, and the solutions to other problems in the prior art, may become apparent to one of ordinary skill in the art in light of the disclosure of the present invention, its manufacture and its use.

SUMMARY OF THE INVENTION

The present invention includes a material member adapted for use in the extremity portion of a protective garment, a flexible extremity portion of a protective garment, a flexible extremity portion of a protective garment containing such a material member, and a protective garment containing such a flexible extremity portion.

In broadest terms, the material member of the present invention is one adapted for use in the extremity portion of a protective garment. The material member, considered as having a vertical axes, a horizontal axes and a flex point at the intersection of said axes comprises at least one layer of material, at least one of those layers containing an aperture defining an aperture area. The aperture encompasses the flex point and extends in both directions along the vertical axes; its width above the horizontal axes being less than its width below the horizontal axes. The aperture is covered by at least one cover piece each having a covering portion thereof covering the aperture. The covering portion(s) is/are of sufficient area whereby the surface area of each of the covering portion(s) is/are greater than the respective aperture area.

The material member may be single or multi-layered. For instance, the material member may comprise two layers of material each with substantially coextensive apertures and each layer of the material having its respective aperture covered by a respective cover piece. As an alternative, an aperture in a single layer of material could be covered with a multi-layered cover piece.

In protective garments it is normally the case that the covering piece, disposed as it is over a joint area, will normally be provided with a sufficient amount of material to provide at least as much protection, if not more, than the layers in the balance of the protective garment. It is also an option that some layers of the garment will be provided with a aperture/cover piece construction in accordance with the invention while others may not. This will depend upon the individual requirements of each layer in each desired garment. For instance, in a firefigther's garment, the outer shell material may be sufficiently oversized to allow free expansion of the other layers of the garment (containing the aperture/-cover piece construction) that such a construction is not necessary in the outer shell. The individual layers of material may be assembled together by any means commonly used in the protective garment art, such as through the use of stitching; or the individual layers may be maintained separate from one another, particularly at the joint location, so as to allow them to move with respect to one another upon flexing of the joint portion of the garment.

The aperture provided in the material member according to the present invention may be of any regular or irregular shape which otherwise meets the positional requirements with respect to the vertical and horizontal axes, and the flex point, as described herein. Such shapes may be, for instance, selected from the group consisting of triangles, trapezoids, trapeziums, tear-dropped shapes, or irregular shapes.

The cover piece(s) may likewise be of any shape appropriate to cover the respective aperture(s), so long as the covering portion(s) thereof meets the geometric and positional requirements described herein, covers the respective aperture(s), has an area greater than the respective aperture(s). These shapes may be selected from the group consisting of triangles, trapezoids, trapeziums, tear-drop shapes, or irregular shapes.

It is preferred that the aperture(s) of the material member be in the shape of a isosceles triangle having a longitudinal axis, aligned substantially along the proximal-distal axis of the extremity portion. Likewise, it is further preferred that the cover piece is formed into the shape of an isosceles triangle by the closure of a dart seam extending from the perimeter of the triangle (such as at its apex) into its interior. This may also be done in the case of aperture/cover piece combinations in the shape of a trapezoid, trapezium, or like figure meeting the geometric and positional requirements herein.

The present invention also includes a flexible extremity portion for a protective garment such as for a firefigther, and the like such an extremity portion may be adapted to cover a flexible body part such as an elbow, a shoulder and/or a knee. The flexible extremity portion of the present invention, considered as having a proximinal-distal axis (aligned substantially along the longitudinal axis of the extremity such portion is adapted to cover), a lateral axis substantially perpendicular thereto, and a flex point at the intersection of these axes; comprises: (1) a tubular passage formed by at least one layer of material so as to define a passage diameter, (2) at least one of such layer(s) of material containing an aperture encompassing the flex point and extending in both the proximal and distal directions along the proximal-distal axis, and having its width on the distal side of the lateral axis being less than its width on the proximal side of the lateral axis; and the aperture covered by the cover piece(s) being of sufficient area whereby the passage diameter is increased at the flex point.

Normally, in protective garments more than one layer of material will be used. Accordingly, it is preferred in such garments that each of the layers contain an aperture and that each such aperture is covered by a respective cover piece of the respective same material so as to maintain the level of protection in the joint area as throughout the balance of the protective garment. For instance, in a firefigther's garment, a flexible extremity portion in accordance with an applicable embodiment of the present invention might include a layer of a thermal barrier material and a layer of a moisture barrier material selected from those commonly known and used in the firefigther's garment art. The firefigther's garment normally also comprises an outer shell abrasion resistant layer which may or may not contain the aperture/cover piece construction of the present invention.

As pointed out above with respect to the material member of the present invention, the aperture(s) and the cover piece(s) may be selected from any shape so long as they meet the geometric and positional requirements with respect to the proximal-distal and lateral axis, the flex point, and the tubular passage diameter. Such shapes may be selected from the group consisting of triangles, trapezoids, trapeziums, tear-drop shapes, or irregular shapes. Also, as with the material member of the present invention, a preferred embodiment of the present invention is to have the aperture/covering piece combination(s) be in the shape of an isosceles triangle, with the cover piece(s) formed into the shape of an isosceles triangle by the closure of at least one dart seam extending from the perimeter into the interior of the isosceles triangle. Also, the same construction may be applied to a aperture-cover piece combination(s) in the shape of a trapezoid, trapezium, or other shape.

The present invention also includes a protective garment containing at least one extremity portion in accordance with the present invention. Such a garment may be assembled in accordance with know practices and procedures in the protective garment art, using materials and methods appropriate to the desired use of the finished garment. Such a garment may include a torso portion having extremity portions of the present invention provided for the arm portions of the garment and/or a trousers portion of such a garment having extremity portions in accordance with the present invention provided for the leg portions of such trousers.

DESCRIPTION OF THE DRAWINGS

FIG. 1 is a plan of view of a trousers portion of a garment containing material members and extremity portions in accordance with one embodiment of the present invention.

FIG. 2 is a side view of the trousers portion shown in FIG. 1 and showing the trousers portion in a flexed position.

FIG. 3 shows an exploded cross-sectional view along line 3—3 showing a material member in accordance with one embodiment of the present invention.

FIG. 4 is a plan view of a precursor piece of material used to form the cover piece material member shown in FIG. 3 and applied in FIGS. 1 and 2.

FIGS. 4*a* and 4*b* are perspective views of the precursor piece of material shown in FIG. 4.

DETAILED DESCRIPTION OF THE PREFERRED EMBODIMENT

Figure 5:
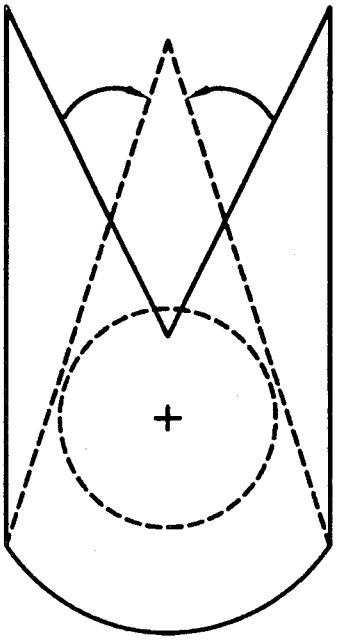
FIGS. 5, 6 and 7 show alternative geometric shapes for the precursor piece of material shown in FIG. 4.

The following presents a description of a preferred embodiment of the present invention which is also presently considered to be the best mode of carrying out the present invention.

FIG. 1 shows a garment piece 1 (i.e. a pair of trousers) prepared in accordance with one embodiment of the present invention. Garment piece 1 contains two extremity portions 3, each extremity portion having a proximal-distal axis 5 and a lateral axis 7 with a flex point 9 at the intersection between the proximal-distal axis 5 and the lateral axis 7. The extremity portion 3 is provided with an aperture 11 which has a width above lateral axis 7 less than that below lateral axis 7, i.e. in the shape of an isosceles triangle encompassing flex point 9. It is preferred that the geographic center of the cover piece (i.e. the center of the largest circle 22 that can be inscribed in the cover piece shape) be disposed over the flex point. Aperture 11 is covered by cover piece 13, the covering portion of which (i.e. that portion inside dotted lines 15) has an area greater than aperture 11 (defined by lines 15) so that the diameter of the tubular passage formed by extremity portion 3 is increased at flex point 9. In this embodiment, this is accomplished as shown in FIGS. 3 and 4 below.

FIG. 2 shows garment piece and extremity portion 3 thereof. Extremity portion 3 comprises a material tubular passage 4. This view shows how the extremity portion 3, containing the material member comprising the aperture 11 and cover piece 13 allow for an extended diameter of the tubular passage of the extremity portion 3 at the flex point.

FIG. 3 shows a multi-layered material member 2 in accordance with a preferred embodiment of the present invention. Material member 2 comprises two base layers of material 4*a* and 4*b* containing, respectively, apertures 11*a* and 11*b*. Aperture 11*a* is covered by cover piece 13*a* which is shown as bowed to show that the area of the covering portion thereof (that covering aperture 11*a*) has an area greater than that of aperture 11*a*. Likewise, aperture 11*b* is covered by cover piece 13*b*. The cover pieces may be attached by any acceptable means known in the art such as through the use of stitching, adhesives, or the like. If stitched, the cover piece is preferable stitched just outside the defining line of the aperture such as, for instance, between dotted line 15 and the edge of cover piece 13*a* as shown in FIG. 1.

Typically in firefigther's garments a thermal insulative layer is combined with a moisture barrier layer. These layers are generally covered with an abrasion resistant layer as the outside layer. In FIG. 3, a typical construction is shown using a thermal barrier layer for 4*b* and 13*b*, a moisture barrier layer for 4*a* and 13*a*, and an abrasion resistant layer 6. This abrasion resistant layer 6 is shown cut away in FIGS. 1, 2 and 3. Because the abrasion resistant layer 6 is normally relatively loose fitting, it may be used as an unaltered layer as shown in FIG. 3 which will still allow it to accommodate the expansion of layers 4*a*/13*a* and 4*b*/13*b* as contemplated in the present invention.

The formation of the cover piece in accordance with one embodiment of the present invention is shown for instance in FIG. 4. FIG. 4 shows the material precursor of cover piece 13*a* which may be formed into an isosceles triangle shape 17 by the closure of edges 19*a* and 19*b* by a dart seam along line 21. By closing the figure in this way, the material of cover piece 13*a* is somewhat stressed so that it will form itself into a flexible, tent-like structure over the aperture it covers, (i.e. aperture 11). The geometry of this closure can be appreciated by comparing FIGS. 4*a* and 4*b*. Once a part of an extremity portion in accordance with the present invention, this structure may be bowed outwardly by its own shaping and/or by action of the joint (i.e. a knee joint) against it. Once so bowed outwardly, this structure allows the joint to be repeatedly flexed while reducing the stress of movement. Also, once bowed outwardly, this structure maintains a small air pocket which can give some enhanced thermal protection to the unflexed joint, and continues to make movement into the joint easier for subsequent flexing.

In this way, the joint of the wearer is best accommodated while the amount of material used and the extent of manufacturing is reduced. The construction of the present invention allows for expansion of the diameter of the tubular passage of the extremity portion only in the areas where it is most needed, such as, particularly, distally from the flex point.

Figure 6:
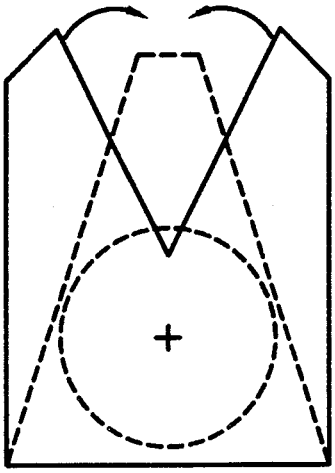
Figure 7:
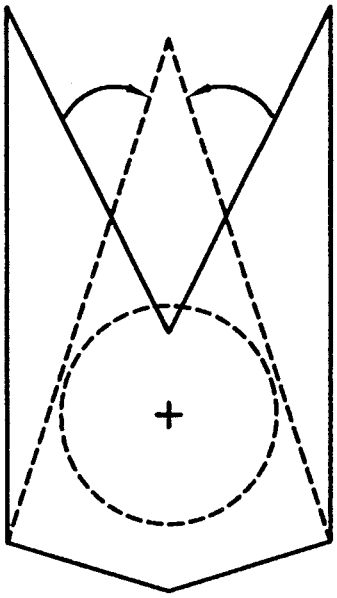

Alternative geometries of the material cover piece of FIG. 4 are shown in FIGS. 5, 6 and 7, which show the formation of geometric shapes such as, respectively, a tear drop, trapezoid/trapezium and an irregular shape.

In view of the foregoing disclosure or through practice of the described invention, it will be obvious to one of ordinary skill in the art to make alterations and modifications, including the substitution of equivalent construction, materials and arrangements to accomplish the present invention's purpose in substantially the same way without departing from the spirit of the invention as reflected in the present disclosure and the appended claims.

What is claimed is:

1. A flexible extremity portion of a protective garment, said portion having a proximal-distal axis, a lateral axis, and a flex point at the intersection of said axes, said portion comprising:

a tubular passage having two end portions and a middle portion and comprising at least one layer of material so as to define a passage diameter in each of said portions;

at least one of said at least one layer of material containing an aperture in said middle portion, said aperture encompassing said flex point and extending in both the proximal and distal directions along said proximal-distal axis, and the width of said aperture on the distal side of said lateral axis is greater than the width of said aperture on the proximal side of said lateral axis; and said aperture covered by at least one cover piece of sufficient area whereby said passage diameter is increased at said flex point while said passage diameter of said end portions is maintained.

2. A flexible extremity portion of a protective garment according to claim 1 wherein each of said layers contain an aperture.

3. A flexible extremity portion of a protective garment according to claim 1 wherein said aperture is in a shape selected from the group consisting of triangles, trapezoids, trapeziums, tear drops and irregular shapes.

4. A flexible extremity portion of a protective garment according to claim 1 wherein said at least one cover piece is in a shape selected from the group consisting of triangles, trapezoids, trapeziums, tear drops and irregular shapes.

5. A flexible extremity portion of a protective garment according to claim 1 wherein said aperture is in the shape of an isosceles triangle having a longitudinal axis and having said longitudinal axis aligned substantially along said proximaldistal axis; and wherein said cover piece is formed into the shape of an isosceles triangle having a perimeter, an interior and a longitudinal axis, said longitudinal axis aligned substantially along said proximal-distal axis, said cover piece isosceles triangle containing at least one dart seam extending from said perimeter into said interior of said cover piece isosceles triangle.

6. A flexible extremity portion of a protective garment according to claim 1 wherein said aperture is in the shape of a trapezoid having a longitudinal axis and having said longitudinal axis aligned substantially along said proximal-distal axis; and wherein said cover piece is formed into the shape of a trapezoid having a perimeter, an interior and a longitudinal axis, said longitudinal axis aligned substantially along said proximal-distal axis, said cover piece trapezoid containing at least one dart seam extending from said perimeter into said interior of said cover piece trapezoid.

7. A flexible extremity portion of a protective garment according to claim 1 wherein said aperture is in the shape of a trapezoid having a longitudinal axis and having said longitudinal axis aligned substantially along said proximal-distal axis; and wherein said cover piece is formed into the shape of a trapezoid having a perimeter, an interior and a longitudinal axis, said longitudinal axis aligned substantially along said proximal-distal axis, said cover piece trapezoid containing at least one dart seam extending from said perimeter into said interior of said cover piece trapezoid.

8. A flexible extremity portion according to claim 1 wherein said portion is adapted to cover a body part selected form the group consisting of an elbow, a shoulder and a knee.

9. A protective garment containing at least one extremity portion according to claim 1.

10. A flexible extremity portion of a protective garment, said portion having a proximal-distal axis, a lateral axis, and a flex point at the intersection of said axes, said portion comprising:

a tubular passage having two end portions and a middle portion and comprising at least two layers of material so as to define a passage diameter in each of said portions, said at least two layers of material comprising a moisture barrier material, an insulative material and an abrasion resistant material, at least one of said layers containing an aperture in said middle portion, each of said apertures encompassing said flex point and extending in both the proximal and distal directions along said proximal-distal axis, and the width of said aperture on the distal side of said lateral axis is greater than the width of said aperture on the proximal side of said lateral axis; and said at least one aperture covered by at least one cover piece of a shape having a perimeter defining an interior having an area of sufficient size whereby said passage diameter is increased at said flex point while said passage diameter of said end portions is maintained, and said cover piece containing at least one dart seam extending from said perimeter into said interior of said cover piece.

11. A flexible extremity portion of a protective garment according to claim 10 wherein said aperture is in a shape selected from the group consisting of triangles, trapezoids, trapeziums, tear drops and irregular shapes.

12. A flexible extremity portion of a protective garment according to claim 10 wherein said at least one cover piece is in a shape selected from the group consisting of triangles, trapezoids, trapeziums, tear drops and irregular shapes.

13. A flexible extremity portion of a protective garment according to claim 10 wherein said aperture is in the shape of an isosceles triangle having a longitudinal axis and having said longitudinal axis aligned substantially along said proximaldistal axis; and wherein said cover piece is formed into the shape of an isosceles triangle having a perimeter, an interior and a longitudinal axis, said longitudinal axis aligned substantially along said proximal-distal axis, said cover piece isosceles triangle containing at least one dart seam extending from said perimeter into said interior of said cover piece isosceles triangle.

14. A flexible extremity portion of a protective garment according to claim 10 wherein said aperture is in the shape of a trapezoid having a longitudinal axis and having said longitudinal axis aligned substantially along said proximaldistal axis; and wherein said cover piece is formed into the shape of a trapezoid having a perimeter, an interior and a longitudinal axis, said longitudinal axis aligned substantially along said proximal-distal axis, said cover piece trapezoid containing at least one dart seam extending from said perimeter into said interior of said cover piece trapezoid.

15. A flexible extremity portion of a protective garment according to claim 10 wherein said aperture is in the shape of a trapezium having a longitudinal axis and having said longitudinal axis aligned substantially along said proximaldistal axis; and wherein said cover piece is formed into the shape of a trapezium having a perimeter, an interior and a longitudinal axis, said longitudinal axis aligned substantially along said proximal-distal axis, said cover piece trapezium containing at least one dart seam extending from said perimeter into said interior of said cover piece trapezium.

16. A flexible extremity portion according to claim 10 wherein said portion is adapted to cover a body part selected from the group consisting of an elbow, a shoulder and a knee.

17. A protective garment containing at least one extremity portion according to claim 10.

18. A flexible extremity portion of a protective garment, said portion having a proximal-distal axis, a lateral axis, and a flex point at the intersection of said axes, said portion comprising:

a tubular passage having two end portions and a middle portion and comprising at least two layers of material so as to define a passage diameter in each of said portions, said at least two layers of material comprising a moisture barrier material, an insulative material and an abrasion resistant material;

at least one of said layers containing an aperture in said middle portion, each of said apertures encompassing said flex point and extending in both the proximal and distal directions along said proximal-distal axis, and the width of said aperture on the distal side of said lateral axis is greater than the width of said aperture on the proximal side of said lateral axis, wherein said apertures are each in the shape of an isosceles triangle having a longitudinal axis and having said longitudinal axis aligned substantially along said proximal-distal axis; and said at least one aperture covered by at least one cover piece having a perimeter defining an interior having an area of sufficient size whereby said passage diameter is increased at said flex point while said passage diameter of said end portions is maintained, and wherein said cover piece is formed into the shape of an isosceles triangle having a perimeter, an interior and a longitudinal axis, said longitudinal axis aligned substantially along said proximal-distal axis, said cover piece isosceles triangle containing at least one dart seam extending from said perimeter into said interior of said cover piece isosceles triangle.

19. A flexible extremity portion according to claim 18 wherein said portion is adapted to cover a body part selected from the group consisting of an elbow, a shoulder and a knee.

20. A protective garment containing at least one extremity portion according to claim 18.

* * * * *

UNITED STATES PATENT AND TRADEMARK OFFICE

CERTIFICATE OF CORRECTION

PATENT NO. : 5,267,354

DATED : December 7, 1993

INVENTOR(S) : William L. Grilliot and Mary I. Grilliot

It is certified that error appears in the above-indentified patent and that said Letters Patent is hereby corrected as shown below:

In column 5, line 28, after the word "piece", please add -- 1 --.

In column 6, lines 23 - 26, please move this paragraph and insert it before the paragraph that begins "In this way,".

In column 7, line 5, please delete the word "proximaldistal" and replace it with the word -- proximal-distal --.

In column 7, line 26, please delete the word "trapezoid" and replace it with the word -- trapezium --.

In column 7, line 29, please delete the word "trapezoid" and replace it with the word -- trapezium --.

UNITED STATES PATENT AND TRADEMARK OFFICE

CERTIFICATE OF CORRECTION

PATENT NO. : 5,267,354

DATED : December 7, 1993

INVENTOR(S) : William L. Grilliot and Mary I. Grilliot

It is certified that error appears in the above-indentified patent and that said Letters Patent is hereby corrected as shown below:

In column 7, line 32, please delete the word "trapezoid" and replace it with the word -- trapezium --.

In column 7, line 34, please delete the word "trapezoid" and replace it with the word -- trapezium --.

In column 8, line 12, please delete the word "proximaldistal" and replace it with the word -- proximal-distal --.

In column 8, line 24, please delete the word "proximaldistal" and replace it with the word -- proximal-distal --.

In column 8, line 35, please delete the word "proximaldistal" and replace it with the word -- proximal-distal --.

Signed and Sealed this

Fifth Day of July, 1994

Bruce Lehman

*Attest:*

BRUCE LEHMAN

*Attesting Officer*

*Commissioner of Patents and Trademarks*